US006113044A

United States Patent [19]

Stratman

[11] Patent Number: 6,113,044

[45] Date of Patent: Sep. 5, 2000

[54] SELF-ADJUSTING FURNITURE LIFTING BRACKET ASSEMBLY

[76] Inventor: Cletus J. Stratman, 3706 Union Rd., St. Louis, Mo. 63125

[21] Appl. No.: 09/050,619

[22] Filed: Mar. 30, 1998

[51] Int. Cl.[7] ..... A47G 29/02; A47F 5/00; B66F 3/00

[52] U.S. Cl. ..... 248/220.42; 248/244; 248/298.1; 254/134; 254/131; 414/917

[58] Field of Search ..... 248/235, 298.1, 248/309.1, 243, 316.4, 231.41, 220.42

[56] References Cited

U.S. PATENT DOCUMENTS

| | | | |
|---|---|---|---|
| Re. 30,533 | 3/1981 | Dushku | 254/113 |
| 192,554 | 6/1877 | Winters . | |
| 502,397 | 8/1893 | Lemons . | |
| 833,331 | 10/1906 | Michaelis . | |
| 891,988 | 6/1908 | Hardy . | |
| 1,047,193 | 12/1912 | Fox et al. . | |
| 1,093,405 | 4/1914 | Hallen . | |
| 1,129,494 | 2/1915 | Kelleher . | |
| 1,176,513 | 3/1916 | Bell . | |
| 1,280,955 | 10/1918 | Bowen | 248/231.41 |
| 1,520,630 | 12/1924 | Bateman . | |
| 1,557,344 | 10/1925 | Schuh . | |
| 2,359,016 | 9/1944 | Wood | 214/65 |
| 2,508,661 | 5/1950 | Campbell | 254/2 |
| 2,514,308 | 7/1950 | Burg | 280/57 |
| 2,706,057 | 4/1955 | Belding | 214/392 |
| 2,716,557 | 8/1955 | Gould et al. | 280/34 |
| 2,723,863 | 11/1955 | Mattio | 280/47.24 |
| 2,738,952 | 3/1956 | Nilson | 254/103 |
| 2,795,859 | 6/1957 | Buschbach | 248/231.41 |
| 2,823,551 | 8/1958 | Utz | 74/141.5 |
| 2,846,233 | 8/1958 | Burg | 280/30 |
| 2,897,989 | 8/1959 | Hounsell | 214/390 |
| 2,994,939 | 8/1961 | Matthews | 28/42 |
| 3,010,592 | 11/1961 | Chadwick | 214/390 |
| 3,132,875 | 5/1964 | Plumly | 280/47.34 |
| 3,145,863 | 8/1964 | Dunaski | 214/390 |
| 3,314,656 | 4/1967 | Haines | 254/103 |
| 3,325,183 | 6/1967 | Elchuck | 280/47.34 |
| 3,327,996 | 6/1967 | Morse | 254/2 |
| 3,338,591 | 8/1967 | Rowland | 280/79.1 |
| 3,346,228 | 10/1967 | Thorman | 248/316.4 |
| 3,409,272 | 11/1968 | Rasmussen | 254/45 |
| 3,486,650 | 12/1969 | Boone | 214/390 |
| 3,570,694 | 3/1971 | Tantlinger | 214/390 |
| 3,672,634 | 6/1972 | Chaffin | 254/2 |
| 3,746,358 | 7/1973 | Swick, Jr. et al. | 280/36 R |
| 3,797,460 | 3/1974 | Blankenship | 119/17 |
| 3,873,118 | 3/1975 | Takagi | 280/47.2 |
| 3,941,352 | 3/1976 | Nehrig et al. | 254/98 |
| 3,963,208 | 6/1976 | Sova | 248/316.4 |
| 4,050,672 | 9/1977 | Lane | 254/10 R |
| 4,073,475 | 2/1978 | Gordon | 254/66 |
| 4,078,774 | 3/1978 | Williams | 254/45 |
| 4,183,511 | 1/1980 | Marek | 269/17 |
| 4,432,521 | 2/1984 | Bevans et al. | 254/100 |
| 4,488,733 | 12/1984 | Hellsten | 280/47.16 |
| 4,491,452 | 1/1985 | Matovich | 414/427 |
| 4,566,708 | 1/1986 | Specie | 280/47.13 R |
| 4,593,883 | 6/1986 | Nelson | 254/7 B |
| 4,659,072 | 4/1987 | De La Rosa | 269/17 |
| 4,669,692 | 6/1987 | Mastrodicasa | 248/250 |
| 4,793,624 | 12/1988 | Mace | 280/47.16 |
| 4,802,708 | 2/1989 | Vos et al. | 248/316.4 |

(List continued on next page.)

FOREIGN PATENT DOCUMENTS

| | | |
|---|---|---|
| 545022 | 8/1957 | Canada . |
| 828631 | 2/1960 | United Kingdom . |
| 1455636 | 11/1976 | United Kingdom . |
| 2060555 | 5/1981 | United Kingdom . |

*Primary Examiner*—Leslie A. Braun
*Assistant Examiner*—Michael Nornberg
*Attorney, Agent, or Firm*—Suelthaus & Walsh, P.C.; John W. Kepler, III

[57] ABSTRACT

A self-adjusting furniture lifting bracket assembly preferably for lifting furniture to provide access to the floor under the furniture, has movable furniture support members mounted on an intermediate support spacing the support members apart. At least one of the support members move in an arc due to a bias member located proximate at least one of the support members.

12 Claims, 3 Drawing Sheets

U.S. PATENT DOCUMENTS

| | | | |
|---|---|---|---|
| 4,846,443 | 7/1989 | Collins et al. | 254/8 |
| 4,902,191 | 2/1990 | Cumbest et al. | 414/729 |
| 4,915,273 | 4/1990 | Allen | 248/316.4 |
| 4,934,893 | 6/1990 | Johnson | 414/458 |
| 4,971,292 | 11/1990 | Craig | 254/7 R |
| 5,028,062 | 7/1991 | Pinnell et al. | 280/47.34 |
| 5,131,629 | 7/1992 | Hillhouse | 254/133 |
| 5,135,205 | 8/1992 | Bedard | 269/17 |
| 5,181,694 | 1/1993 | Collins | 254/133 R |
| 5,234,197 | 8/1993 | Wurdack | 254/94 |
| 5,253,887 | 10/1993 | Marenger | 280/79.3 |
| 5,261,643 | 11/1993 | Wurdack | 254/106 |
| 5,273,256 | 12/1993 | Chambers | 254/45 |
| 5,385,335 | 1/1995 | Wurdack | 254/1 |
| 5,447,386 | 9/1995 | Wurdack | 403/403 |
| 5,490,757 | 2/1996 | Stratman | 414/680 |
| 5,628,610 | 5/1997 | Stratman | 414/680 |
| 5,788,202 | 8/1998 | Richter | 248/316.4 |
| 5,836,563 | 11/1998 | Hsin-Yung | 248/316.4 |

SELF-ADJUSTING FURNITURE LIFTING BRACKET ASSEMBLY

BACKGROUND OF THE INVENTION

The present invention relates in general to furniture and partition lifting and pertains, more particularly, to a self-adjusting furniture lifting bracket assembly intended for use with equipment for lifting furniture, partitions or other articles (hereinafter referred to interchangeably as furniture or partitions) in order to access the floor surface beneath the furniture. The self-adjusting furniture lifting bracket assembly of this invention is an improvement over conventional brackets and bracket assemblies used in association with furniture lifting equipment.

With conventional lifting equipment it is generally necessary to first select a correct bracket for use with a particular piece or pieces of furniture, such as, office partitions. This selection process often requires trial and error and furniture dimensions that vary from nominal dimensions have the potential to create problems for the user of the lifting equipment and the lifting brackets and lifting bracket assemblies.

Selecting the correct bracket requires identifying a bracket or brackets that fits into openings provided in the furniture. The openings more often than not serve another function, however, it remains common place to utilize these almost always present openings in the furniture to lift the furniture; and the bracket or brackets used to utilize these openings for lifting the furniture requires must have sufficient strength and size to support and lift the furniture.

Often a manufacturer or fabricator of lifting equipment provides a plurality of brackets for use with the lifting equipment. The bracket selected for use with a particular partition or piece of furniture may not, however, work properly with another partition or piece of furniture that does not have openings of either the same size or the same spacing as the previous partition lifted or moved in the course of accessing the area beneath the partition.

Each bracket is typically a thin plate with teeth, inserts, extensions or the like extending from an edge of the bracket and shaped for insertion into the furniture openings and then supporting the furniture during lifting. Typically, the manufacturer or fabricator provides the attachment portions for attaching the bracket or brackets or bracket assembly to the lifting equipment.

Ideally, the design of a lifting bracket matches the type and style of both a lifting apparatus used in a particular application, and a piece of furniture, a cubicle partition or other articles found resting on the floor in an office and which require lifting off the floor for the purpose of, among other purposes, the removal and replacement of flooring. However the multitude of opening sizes and spacing of the openings, particularly the spacing of the openings challenges the manufacturer's or fabricator's ability to select a single design suitable for all furniture.

Furniture opening spacing becomes particularly critical when attempting to lift two pieces of adjoining furniture. Then the lifting apparatus preferably supports a double bracket assembly as the size of most lifting devices inhibits side-by-side placement of two lifting devices with a single bracket for lifting two adjoining furniture pieces independently yet simultaneously.

Furthermore, the adjoining furniture pieces are usually joined together in some fashion. Thus, it is desirable to lift both of the adjoining pieces of furniture simultaneously with a single lifting device with a double bracket lifting bracket assembly.

However, elevating adjoining furniture pieces from a fixed point causes the two adjoining pieces of furniture, adjoining office space partitions for example, to separate during lifting. Even the sometimes short distance that the furniture needs to be elevated to access the floor under the furniture often causes some separation of the adjoining furniture pieces and, thereby, the separation of the furniture openings into which the brackets are inserted.

A drawback of existing lifting brackets and lifting equipment is the inability to adjust for the separation of the adjoining furniture pieces during the lift and the coming back towards each other during the drop. The present invention overcomes this and other drawbacks of existing furniture lifting equipment.

Another drawback to conventional brackets and bracket assemblies relates to the rigidity of a bracket assembly assembled or fabricated from a pair of brackets and an intermediate member joining the brackets. For example, when the furniture pieces or the openings in the adjoining furniture pieces are damaged or shifted such that the center-to-center distance between the openings in the adjoining furniture pieces has altered from the original distance for which the lifting bracket assembly has been manufactured, then the furniture that is to be lifted has shifted distorted so as to alter the center-to-center spacing between the openings and the rigidly assembled or fabricated lifting bracket assembly will not fit into the furniture openings as intended due to the now altered spacing of these openings.

The conventional bracket member comprises a single piece metal bracket or a pair of metal lifting brackets, typically manufactured or fabricated from a metal plate member. The lifting apparatus supports the lifting bracket assembly in any one of a number or variety of possible design configurations.

Adjusting the height of the lifting apparatus portion supporting the lifting bracket, brackets or bracket assembly defines the conventional method for adjusting the height of the lifting bracket plate or plates. As the height of the lifting bracket, bracket or bracket assembly changes due to the movement of the lifting apparatus, the insertion members or extensions of the lifting bracket plate which have been inserted into the furniture openings raise or lower the position of the item of furniture.

In a lifting bracket assembly having a plurality of individual lifting brackets, alteration of the furniture lifting opening spacing impedes the desired insertion of the lifting bracket. Once the spacing of the openings in the furniture alters from the original design, then there is often no bracket assembly constructed that fits the now skewed furniture openings sufficiently so as to allow the furniture to be lifted.

Possibly the only positive aspect of this furniture opening spacing shift is that it is usually only a horizontal shift. Therefore, an adjustable assembly is desired that adjusts for a horizontal shift of the spacing or center-to-center distance between the holes or openings in the furniture that are to be used to lift the furniture.

SUMMARY OF THE INVENTION

Accordingly, it is an object of the present invention to provide a self-adjusting furniture lifting bracket assembly that is adapted to increase furniture lifting efficiency. With the self-adjusting furniture lifting bracket of this invention furniture lifting productiveness increases due to the self-adjusting characteristic of the invention that allows insertion of the bracket whether or not the pattern of bracket receiving openings formed in the furniture exactly registers with the lifting extensions of the self-adjusting bracket assembly.

Another object of the present invention is to provide a self-adjusting furniture lifting bracket assembly that is manufactured to provide nearly automatic self-adjustment for a variety center-to-center distances between furniture openings for initial insertion of the lifting bracket assembly and as adjoining lifted furniture pieces separate during lifting. Thus, as insertion of the bracket portions of the lifting bracket assembly into the bracket receiving openings associated with the furniture occurs, the bracket insertions members move or do not move in adjustment to the furniture opening spacing in accordance with the actual center-to-center distance between the furniture openings because of the self-adjustment feature of the present invention and the brackets continue to self-adjust as the furniture is lifted and as it is lowered by the furniture lifting equipment.

A further object of the present invention is to provide a self-adjusting furniture lifting bracket assembly that is adapted for use with most furniture lifting equipment. The present invention provides for or can be adapted to provide for attachment to furniture lifting equipment without interference with the self-adjustment assembly of the invention.

Still another object of the present invention is to provide a self-adjusting furniture lifting bracket assembly that may be readily interchanged with another self-adjusting bracket assembly of the present invention or with a conventional bracket or bracket assembly as required by the user and the circumstances. The function of the self-adjusting furniture lifting bracket assembly of this invention is not limited by any particular shape of the plates or extension pattern and the present invention is intended for operation with lifting bracket members having different shapes and spaced insertion members in addition to those selected for purposes of illustration and understanding of the present invention.

Still a further object of the present invention is to provide a self-adjusting furniture lifting bracket assembly that is adapted for interchangeability of either the lifting brackets on the bracket assembly as well as for interchangeability of self-adjusting bracket assemblies on the lifting equipment.

Another object of the present invention is to provide a self-adjusting furniture lifting bracket assembly in which a preferred embodiment supports two lifting brackets. The bracket assembly of this invention is adapted to use two identical lifting brackets or different lifting brackets depending upon the shape and pattern of the furniture openings receiving the lifting brackets.

To accomplish the foregoing and other objects of this invention there is provided a self-adjusting furniture lifting bracket assembly for use in cooperation with furniture lifting equipment to raise and lower furniture. The furniture is usually raised to provide access to the floor or flooring underneath the furniture and then lowered once access is no longer required.

In a typical office partition design, the self-adjusting furniture lifting bracket assembly of the present invention is used where each pair of adjoining furniture partitions meet. The furniture lifting equipment lifts one end of each partition while the other ends of each partition remain stationary, thereby resulting in the separation of the adjoining partitions during lifting and a coming together during lowering.

The self-adjusting furniture lifting bracket assembly comprises a self-adjusting bracket assembly having a pair of side members. Each side member may include furniture support portions or extensions.

The individual side member furniture support portions may have any number of furniture supporting extensions of projections. The shape of any of these projections may vary without departing from the scope and intent of the present invention.

In the disclosed embodiment described herein, there is provided a self-adjusting bracket assembly. This assembly incorporates spacers or separators, furniture supporting members, fasteners and a spring-loaded self-adjusting assembly for the furniture supporting members.

Also, in the preferred embodiment the assembly includes a spacer or separator member provided with openings. The spacer mounts on the furniture lifting equipment as illustrated and described, thereby supporting the assembly for use with the furniture lifting equipment and different shaped and dimensioned separator members or spacers may be kept on hand to provide for further accommodation of a variety of furniture designs and in particular the spacing of the openings which receive the brackets for lifting the furniture.

These and other objects and features of the present invention will be better understood and appreciated from the following detailed description of one embodiment thereof, selected for purposes of illustration and shown in the accompanying drawings.

DETAILED DESCRIPTION

Figure 1:
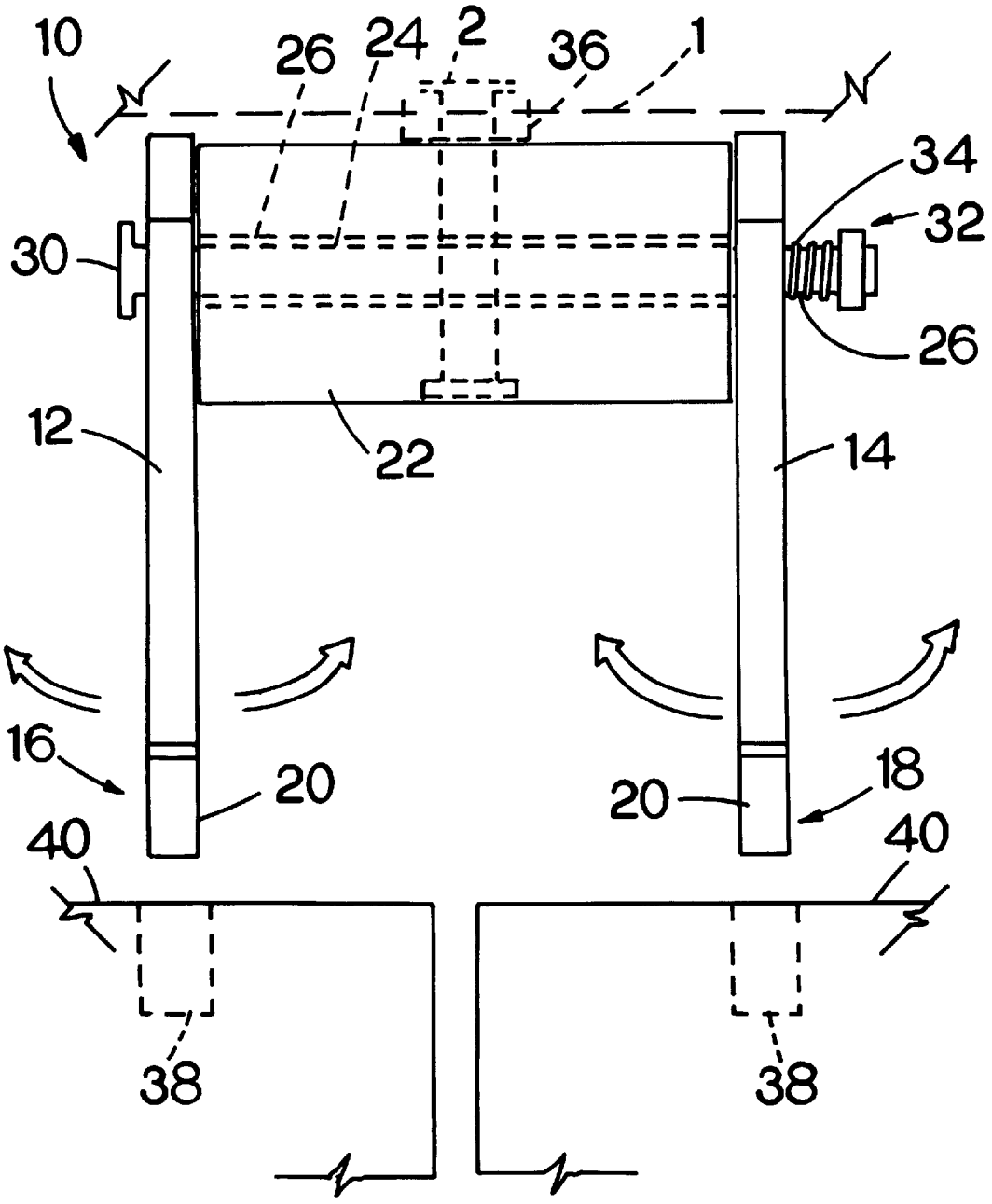
FIG. 1 is a plan view of a self-adjusting furniture lifting bracket assembly constructed in accordance with the present invention including a schematic depiction of a furniture member to be lifted by the invention.
Figure 2:
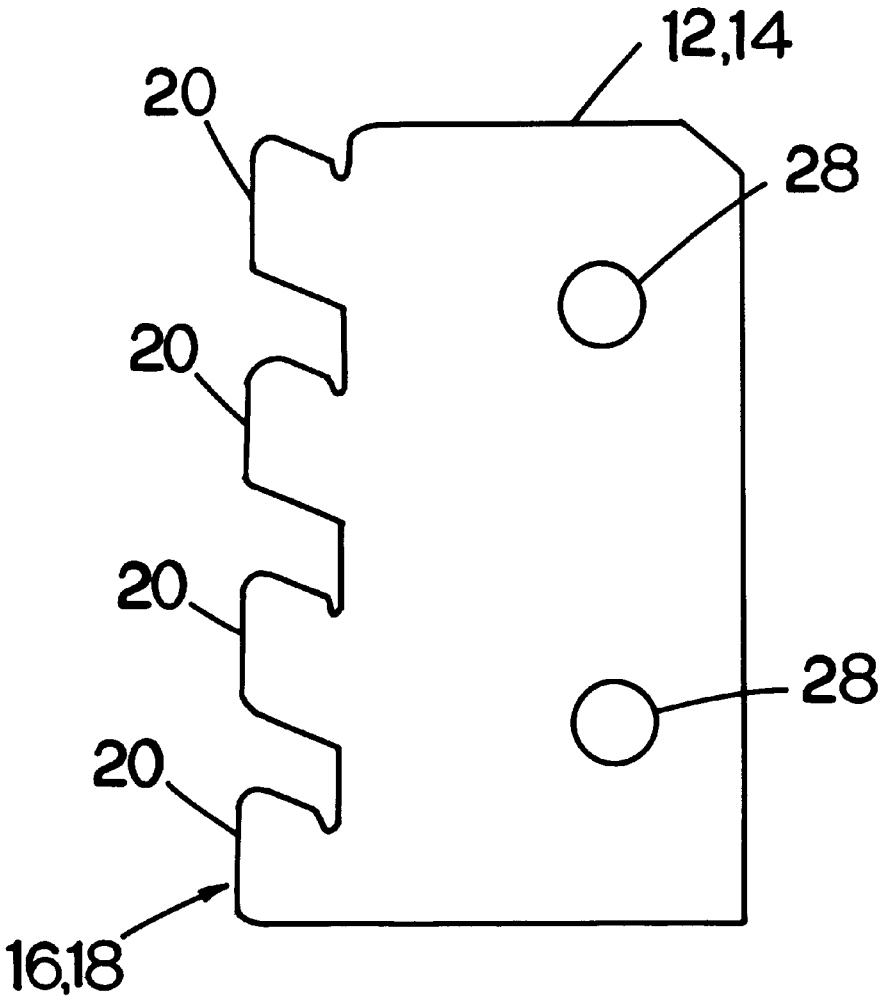
FIG. 2 is a side elevational view of a preferred bracket used with the self-adusting furniture lifting bracket.
Figure 3:
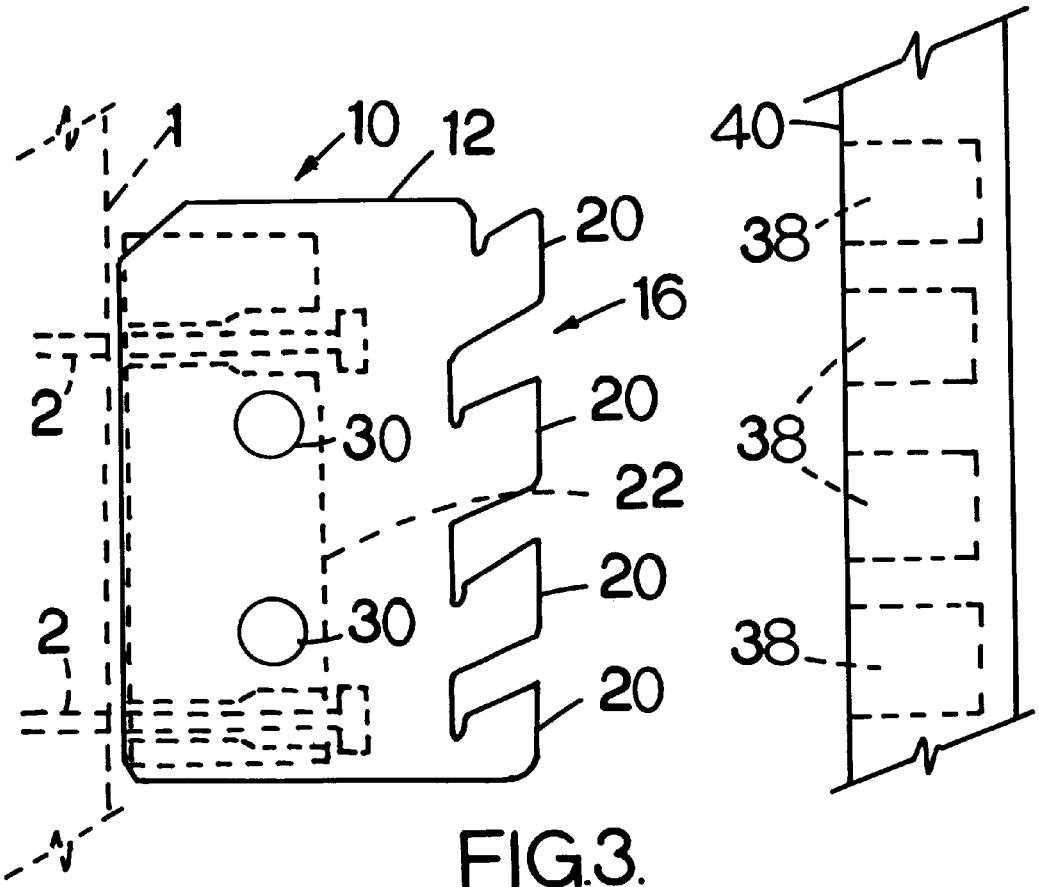
FIG. 3 is a side elevation view of the bracket assembly depicted in FIG. 1, including a schematic depiction of the furniture to be lifted.
Figure 4:
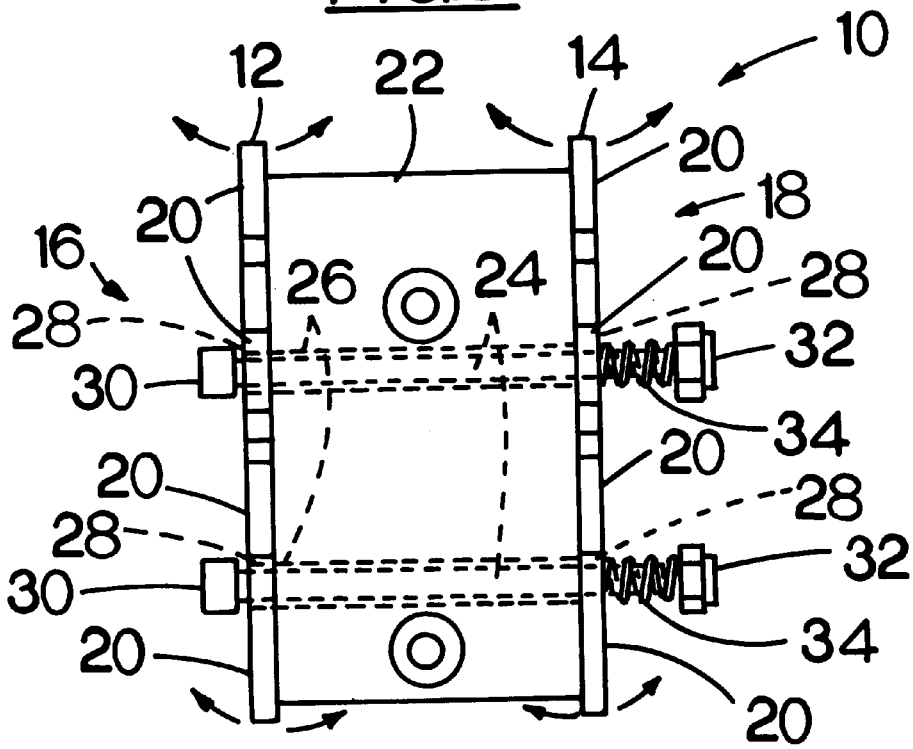
FIG. 4 is a side elevational view of the bracket assembly depicted in FIG. 1.

Referring now to the drawings there is shown a preferred embodiment of the self-adjusting furniture lifting bracket assembly of this invention. The bracket assembly is described in connection with a furniture lifting application to raise and lower furniture and, more particularly for purposes of illustration and understanding, a pair of adjacent partitions.

The self-adjusting furniture lifting bracket of the present invention is particularly adapted for providing access to floor space underneath the furniture or floor space upon which the furniture is resting. The present invention is characterized by an improved ability to function with articles of furniture with dimensional tolerances that vary from factory specifications or articles of furniture with dimensional variations caused by any number of factors, such as, age, mis-use, or damage resulting from poor or careless installation or removal or dimensional changes that take place during lifting and lowering the furniture.

The drawings show the self-adjusting bracket assembly 10 in conjunction with a piece of furniture lifting equipment 1. The lifting equipment includes an attachment member or members 2 suitable for attaching the bracket assembly 10 to the lifting equipment 1 for use in lifting furniture.

The furniture lifting equipment 1 includes a raising and lowering mechanism (not shown). Operating the raising and lowering mechanism raises and lowers the bracket assembly of the present invention and, thereby, raises and lowers the furniture attached to the bracket assembly.

The bracket assembly 10 includes at least two (2) support members and in a preferred embodiment illustrated in the drawings the support members include a first side furniture support member plate 12 and a second side furniture support member plate 14. Either one or both of the support plates include a first side member furniture support portion 16 and a second member furniture support portion 18.

One preferred embodiment of the present invention includes a plurality of furniture supporting projections 20. The projections illustrated in the drawing figures are identical but need not be identical for the present invention to function as intended.

Neither the furniture supporting projections 20 nor the support plates 12, 14 need to be identical so long as the supporting projections sufficiently match or are identical to the number of openings and the opening pattern of the furniture. The supporting projections need not match the openings in the furniture exactly due to the self-adjusting feature of the bracket assembly.

A separator member for separating the furniture supports is located intermediate the furniture supports and separates and supports two or more furniture supports. In a preferred embodiment the separator member for separating the furniture support member plates comprises a furniture support member plate spacer 22.

Spacer 22 receives one or more side member fasteners 24. The drawings illustrate two side member fasteners for purposes of illustration.

The number of these fasteners depends upon the application. Determining the adequate number of fasteners for a particular application depends upon size and weight of the furniture and the strength of the bracket assembly.

The spacer 22 includes one or more transverse spacer openings or bore 26 through which side member fasteners 24 pass. The opposing ends of the side member fasteners extend outwardly through support member plate openings 28 and outwardly from the support member plates 12, 14 a distance sufficient to allow at least one side member fastener end member fastener 30 or both as conditions dictate to attach to the outwardly extending end of each side member fastener 24.

In a preferred embodiment, a side member fastener end member 32 is of sufficient size to retain a self-adjusting assembly spring 34. The spring or other equivalent biasing member is preferably located between the fastener end member 32 and the support member plate 18, although the location of the biasing member may vary so long as the other location or locations still provides for support member plate 12, 14 adjustment.

In operation, in connection with the furniture lifting application previously mentioned to raise and lower furniture and obtain access to the floor underneath the furniture, the member for supporting the spacer 22 by the lifting equipment 1 is provided by a combination of attaching members 2 placed through the spacer or separator 22 so as to provide a supporting member 36 for supporting the spacer with the lifting equipment. The supporting member 36 is typically a mounting block, plate or similar structure sturdy enough to support the self-adusting lifting bracket assembly and the furniture being raised and lowered.

The self-adjusting bracket assembly 10 is aligned with openings 38 in the furniture 40 intended to be lifted. The self-adjusting lifting brackets are inserted into the openings 38 and furniture movement commences.

With the lifting equipment and the self-adjusting bracket assembly inserted into the furniture openings the lifting equipment is raised until access to the floor underneath the furniture is obtained. In a preferred embodiment, this signals the flooring crew to prepare for removal and replacement of the flooring.

As the adjacent pieces of furniture 40 are lifted, for example adjacent office partitions, the partitions tend to separate and, therefore, so do the openings 38 into which the lifting bracket assembly 10 has been inserted. The self-adjusting bracket assembly of the present invention accommodates this separation since the lifting bracket members are not rigidly attached to the spacer or separator block 22.

After completing the flooring work, the lifting equipment lowers the furniture and removal of the bracket assembly from the furniture takes place. Repeating these steps allows flooring removal and replacement by the flooring crew.

Another problem addressed and solved by the present invention relates to damaged furniture units which tend to impede the process described above. Conventional lifting brackets fail to match the pattern of the damaged furniture, thereby often resulting in an attempt to make the conventional bracket work as if no damage to the furniture exists, but as often as not to no avail.

Moving the lifting equipment may not be sufficient to enable insertion of furniture support members into the damaged or misaligned pattern of holes or openings in the furniture. With the present invention, the furniture support member plates move in response to misalignment due to the bias member or spring portion of the assembly.

In a preferred embodiment the two side member furniture support portions 16, 18 attached together through spacer 22 tends to continue to adjust during furniture raising and lowering. Thus, once inserted into the furniture openings, the plurality of support member plates and their respective furniture support portion tend to adjust for both separation during lifting and misalignment due to damage or the like to the furniture pieces.

It will be understood that lifting two office partitions, for example, with a single lifting bracket will result in partition separation. It will be further understood that partition lowering results in the partitions returning to their adjacent positions and the self-adjusting bracket assembly of the present invention provides for this movement during lifting and lowering of the furniture.

With the bracket assembly of the present invention, operation in the event of damaged furniture can often proceed without impediment. Center-to-center distance between openings in the furniture may vary, however, the possibility of removing one plate spacer 22 and substituting another wider or narrower plate spacer 22 or substitute lifting brackets gives the present invention additional flexibility of use.

Another flexible aspect of the present invention resides in the ability to loosen or tighten the spring 34, thereby providing for more or less movement (as indicated by the arrows) of the support member plates 12 and 14. In addition, the capability of changing the spring also included as a feature of the present invention provides additional ability to vary the maximum movement of the support member plates, that is, a relatively stronger spring creates more force holding the plates in place and a relatively weaker spring creates less force holding the plates in place.

While specific embodiments have been shown and described, many variations are possible. The particular shape of the bracket assembly and the materials from which it is manufactured may be varied to suit the particular application for which it is intended.

The dimensions of the support member plates and the furniture supporting projections may be varied to suit the furniture to be lifted. It is expected that someone using the present invention will keep different plates or entire assemblies on-hand.

Similarly, the present invention does not depend upon the design of the spring or other bias member except that it is understood that the brackets must be capable of moving as generally indicated by the arrows included in the drawing figures. While coil springs are described, it will be further understood that other spring designs are suitable for use in the present invention.

From the foregoing description those skilled in the art will appreciate that all of the objects of the present invention are realized. A self-adjusting bracket assembly for use with furniture lifting equipment has been shown and described for providing the desired furniture support and access to the area or floor under the furniture.

The bracket of this invention increases furniture lifting efficiency due to the movability of the spring mounted furniture support members carried by the bracket assembly. The furniture support member plates move in response to misaligned or damaged openings in the furniture as the bracket is inserted into the furniture openings.

The furniture supporting members or portions of the bracket align themselves without the need for manual intervention, except in the most extreme instances of misaligned or damaged furniture. Thus, overall efficiency improves as the adjusting characteristic of the invention allows immediate insertion of the bracket whether or not the pattern of bracket receiving openings formed in the furniture exactly register with the self-adjusting bracket.

The construction of the bracket assembly of the present invention allows nearly automatic adjustment of center to center distance between bracket insertion members due to the movable characteristics of the furniture support members or portions. This is so since as insertion of the bracket assembly into the bracket receiving openings associated with the furniture proceeds the bracket insertions members move or do not move accordingly to fit into the receiving openings.

A spacer intermediate the furniture support members or portions of the bracket incorporates the adaptation necessary such that use of the bracket assembly of the present invention does not depend upon the type or style of furniture lifting equipment. The present invention adapts to attachment to furniture lifting equipment without interfering with the self-adjustment assembly of the bracket.

The self-adjusting furniture lifting bracket assembly interchanges with other bracket assemblies since the present invention functions independent of the shape of the plates or pattern of the insertion members. Furthermore, the capability to interchange the furniture supporting members or portions provided by the present invention increases its adaptability and flexibility.

A preferred embodiment of the present invention supports two lifting brackets. Therefore, the bracket assembly of this preferred embodiment uses either two identical lifting brackets or two different lifting brackets or one furniture lifting member and one non-furniture lifting member depending upon the shape and pattern of the furniture openings provided for receiving the lifting brackets.

Having described the invention in detail, those skilled in the art will appreciate that modifications may be made of the invention without departing from its spirit. Therefore, it is not intended that the scope of the invention be limited to the specific embodiments illustrated and described, rather, it is the intended that the scope of this invention be determined by the appended claims and their equivalents.

What is claimed is:

1. A bracket assembly used during lifting, comprising:

a first support member;

second support member;

wherein one of the first or second support member further comprises one or more supporting projections;

an intermediate member located between the first support member and the second support member, the intermediate member defines an initial spacing between the first support member and the second support member; and self-adjusting assembly for adjustably attaching the intermediate member to the first support member, the self-adjusting assembly partially supported by the intermediate member.

2. A bracket as set forth in claim 1 wherein the self-adjusting assembly for adjustably attaching the intermediate member to both the first support member and the second support member includes a bias member.

3. A bracket as set forth in claim 1 wherein the first support member is a plate member.

4. A bracket as set forth in claim 1 wherein the first support member and the second support member are a first plate member and a second plate member.

5. A bracket as set forth in claim 1 wherein the intermediate member is a spacer member located between the first support member and the second member.

6. A self-adjusting furniture lifting bracket assembly for assisting in the lifting of furniture, comprising:

a first side member;

the first side member having a first insertion portion for engaging the item of furniture;

a second side member;

the second side member having a second insertion portion for engaging the item of furniture;

a separator member having at least one bore for separating the first side member from the second side member;

a connecting member for passing through said bore connecting the first side member, the second side member and the separator for separating the first side member from the second side member; and a bias member for providing relative movement between the first side member and the second side member, whereby the first side member and the second side member move relative to each other such that the first insertion portion for engaging the item of furniture and the second insertion portion for engaging the item of furniture each adjust so as to insert into at least one opening suitable for receiving the one or the other of the first insertion portion for insertion into the item of furniture and the second insertion portion for insertion into the item of furniture.

7. A self-adjusting furniture lifting bracket assembly as set forth in claim 6 wherein the first and second side members are each generally geometrically planar plate members.

8. A self-adjusting furniture lifting bracket assembly as set forth in claim 6 wherein at least one insertion portion for insertion into the item of furniture includes at least one projection suitable for insertion into an opening provided in the item of furniture.

9. A method of raising and lowering a pair of adjacent furniture pieces with a pair of brackets attached to an apparatus suitable for lifting the furniture, comprising the steps of:

inserting the brackets into openings located in each of a plurality of adjacent furniture pieces, wherein the brackets are separated an initial distance by a spacer;

moving the brackets with a lifting apparatus suitable for moving the furniture; and adjusting the center to center distance between the brackets with a bias member as the furniture moves.

10. A method as set forth in claim 9 further comprising the step of adjusting the applied force of the bias member as it relates to the adjusting movement of the brackets and the center to center distance between the brackets.

11. A method as set forth in claim 9 further comprising the step of adjusting the initial center to center space between the brackets by removing one spacer and inserting another spacer in its place so as to effectively change the initial distance between the brackets.

12. A method of raising or lowering two adjacent furniture pieces, the steps comprising:

supporting a first insertion portion and a second insertion portion with a self-adusting assembly;

inserting the first insertion portion into a piece of furniture;

inserting the second insertion portion into an adjacent piece of furniture; and adjusting the spacing between the first insertion portion and the second insertion portion with the self-adjusting assembly as either the first insertion portion or the second insertion portion or both insertion portions insert into the respective pieces of furniture.

* * * * *